US005283549A

United States Patent [19]

Mehaffey et al.

[11] Patent Number: 5,283,549

[45] Date of Patent: Feb. 1, 1994

[54] INFRARED SENTRY WITH VOICED RADIO DISPATCHED ALARMS

[75] Inventors: Joseph H. Mehaffey; J. Sutton Mehaffey, both of Atlanta, Ga.

[73] Assignee: Intellitech Industries, Inc., Kennesaw, Ga.

[21] Appl. No.: 708,899

[22] Filed: May 31, 1991

[51] Int. Cl.[5] ..... G08B 19/00

[52] U.S. Cl. ..... 340/521; 340/460; 340/506; 340/531; 340/539; 340/565; 340/692; 381/110

[58] Field of Search ..... 340/506, 539, 521, 692, 340/531, 565, 460; 381/110

[56] References Cited

U.S. PATENT DOCUMENTS

| | | | |
|---|---|---|---|
| 4,228,424 | 10/1980 | LeNay et al. | 340/506 |
| 4,455,551 | 6/1984 | Lemelson | 340/539 |
| 4,494,111 | 1/1985 | Rocci et al. | 340/531 |
| 4,631,527 | 12/1986 | De Witt et al. | 340/531 |
| 4,724,425 | 2/1988 | Gerhart et al. | 340/531 |
| 4,734,680 | 3/1988 | Gehman et al. | 340/531 |
| 4,772,875 | 9/1988 | Maddox et al. | 340/565 |
| 4,821,027 | 4/1989 | Mallory et al. | 340/692 |
| 4,894,642 | 1/1990 | Ashbaugh et al. | 340/692 |

OTHER PUBLICATIONS

Brochure "Guardzone" Fast Portable Security by GEC Marconi Limited 1990 (4 pages).

Pamphlet: "Someone to Watch Over Us . . . Guardian" by ML Aviation Limited, Security Products Div., 945 Concord St., Farmingham, MA 01701, (2 pages).

*Primary Examiner*—John K. Peng
*Assistant Examiner*—Edward Lefkowitz
*Attorney, Agent, or Firm*—Hopkins & Thomas

[57] ABSTRACT

An electronic security sentry for monitoring a designated area to detect unauthorized intruders comprises a housing that contains a microprocessor controller, a power source, and a two-way radio transmitter coupled to the microprocessor. The microprocessor controller includes storage for storing the digital equivalents of a predetermined set of verbal commands. A set of passive infrared detectors are coupled to the controller and mounted to the housing such that their fields of coverage span the area to be monitored. Upon detection by the sensors of an unauthorized intruder, a signal is conveyed to the microprocessor which selects a predetermined set of digitized verbal commands from its memory, activates the two-way radio in its transmit mode, and conveys the commands in a predetermined sequence to the two-way radio. The sequence of verbal commands are then transmitted by the radio for receipt by the security guards of an adjunct guard force, who can respond to the alarm accordingly. A number of different types of sensors, such as temperature sensors, moisture sensors, tilt sensors, and the like are also coupled to the controller and predetermined messages corresponding to activation of these sensors can be broadcast when one of the sensors is activated.

6 Claims, 9 Drawing Sheets

RESET-MODE B

INFRARED SENTRY WITH VOICED RADIO DISPATCHED ALARMS

TECHNICAL FIELD

This invention relates generally to electronic security systems and more particularly to passive infrared security systems for detecting an unauthorized presence and reporting the detection to security personnel.

BACKGROUND OF THE INVENTION

Security guard forces have long been employed to patrol and protect property against unauthorized intrusion and vandalism. Such forces are common in large industrial complexes housing valuable equipment, inventory, or sensitive information. These complexes include, for example, store rooms, computer rooms, warehouses, manufacturing facilities, office buildings, military bases, department stores and the like. Prior to the introduction of portable two-way radios, such complexes would usually be patrolled by a team of guards with each guard periodically patrolling a designated area of the complex and returning to a central station to report. Obviously, this left most areas of the complex unattended for long periods of time between patrols.

With the introduction of portable two-way radios, each guard of a team could be stationed permanently in his designated area and could report in periodically to a central station via radio. He could also receive instructions via radio from the central dispatcher so that he could be advised quickly and efficiently of a change in his assignment or of an unusual or threatening situation. While such a system is an improvement over roving patrols, it is still subject to numerous inherent problems. The guards, for example, being human, are subject to inattention and can sometimes be evaded by a clever intruder. This is particularly true in situations where little or no activity over long periods of time can lead to extreme boredom and fatigue among the guards. Probably the most serious problem with posted human sentries is the extremely high cost in salaries and benefits of maintaining the necessarily large security force. Further, frequent turnover among security guards can lead to high training costs and reduced overall efficiency.

In recent years, electronic security systems have found widespread use as an adjunct to traditional radio dispatched security guard forces. Such systems can include passive infrared or heat sensors mounted in designated areas of a guarded complex and positioned to detect the presence of a person within the area. Upon such detection, the sensor, which is usually hard wired to a central control, signals the central control, which can emit a visual or audible signal indicating that an intruder has been detected.

Such security systems have allowed reduction in the number of persons required to guard a complex. Further, they are not subject to boredom, fatigue and evasion as human sentries can be. However, these motion detecting security systems are relatively simple, are not generally portable or easily adaptable to changing requirements, and convey no useful information in addition to a simple signal that a detection has been made. Accordingly, a guard responding to a detection must enter the monitored area with little or no information about where in the area the intruder was detected or how he may have been moving within the area.

Thus, a continuing and unaddressed need exists for an electronic security sentry system adapted to serve as an adjunct to a security guard force and capable of continuous surveillance of a designated area to detect any unauthorized presence. The system should be completely portable and easily adaptable to changing locations, time schedules, and circumstances. Upon a detection, the system should report to the entire guard force by two-way radio and in spoken words the details of the detection. Reports of other conditions such as time, temperature, tampering, and moisture presence should also be provided. It is to the provision of such a system that the present invention is primarily directed.

SUMMARY OF THE INVENTION

The present invention, in one preferred embodiment thereof, comprises a self contained portable electronic security sentry that provides 360 degree passive infrared surveillance of a designated area and that reports via two-way radio and in English (or any other language) when an intruder or other threatening condition is detected. The invention is embodied within a generally rectangular column that extends upwardly from a weighted base and that has an array of four passive infrared (PIR) sensors mounted about its upper periphery. Each sensor includes a lens adapted to focus infrared energy from an angular field of view slightly larger than ninety degrees onto the sensor's detector element. In this way, the fields of view of the sensors overlap slightly to provide a full 360 degree field of coverage. The sensors are adapted to detect heat from objects such as human bodies within their respective fields of view and produce a signal upon such detection.

The PIR sensors are coupled within the sentry to an appropriately programmed microprocessor based controller that in turn is coupled to an electronic store of digitized word commands and to a two-way radio transceiver, through which commands can be broadcast or received. Upon receipt of a detection signal from one of the PIR sensors, the microprocessor determines which of the four sensors has made the detection, accesses the store of digitized word commands to select a predetermined sequence of words corresponding to the activated sensor, activates the send circuit of the two-way radio, and broadcasts over the radio the message comprising the predetermined word sequence. For example, if each sensor is considered to cover a ninety degree quadrant and the sentry is placed in a warehouse, an appropriate message might be "intruder, warehouse, quadrant three". This broadcast message would be received simultaneously by all guards carrying a compatible two-way radio, who would know instantly that an intruder had been detected in the warehouse and further would be informed where in the warehouse the detection had been made. The incident could then be investigated promptly by one or more security guards preappointed to be responsible for the warehouse.

The system of this invention is also provided with means for monitoring its own internal condition such as the condition of its battery, its temperature, etc., and broadcasting its condition in English on command or upon detection of an abnormality. Sensors are also provided to detect an assault on the sentry apparatus itself and to broadcast an emergency message in that event. Other sensors for detecting and triggering a verbal radio dispatched message upon the detection of other threatening conditions such as rising water can also be provided if desired. Periodic "all clear" messages can be broadcast to apprise guards that the system is operational and that the situation is normal.

Thus, the electronic sentry alarm system of this invention provides the basic functions of a posted guard, i.e. keeping guard over an area, reporting in periodically by radio, and informing other guards and the dispatcher by radio when an intruder or other abnormal condition is detected. These functions are in fact performed by the system more consistently and reliably than they can be performed by human guards because the computer and electronics of the system are not subject to the boredom, fatigue, and mistake of judgment to which human guards can fall prey. Finally, and not least significantly, the system of this invention can be put in place for a fraction of the cost of providing a human guard, thus making it economical as well as reliable.

It is therefore an object of this invention to provide an improved electronic infrared intruder detection and alarm system particularly suited to use as an adjunct to a security guard force.

It is another object of the invention to provide such a system wherein detailed verbal messages are broadcast over a two-way radio upon the detection of an intruder or other abnormal condition.

A further object of the invention is to provide an infrared sentry with voiced radio dispatched alarms that is completely self contained and portable.

Another object of the invention is to provide a portable infrared sentry adapted to detect and report verbally by radio a variety of conditions such as internal conditions, temperature, time, moisture, and tampering.

A still further object of the invention is to provide an electronic sentry system that is reliable, user friendly, selectively programmable and cost effective relative to the costs of providing a human sentry.

These and other objects, features, and advantages of the present invention will become more apparent upon review of the following detailed description taken in conjunction with the accompanying drawings.

DETAILED DESCRIPTION OF THE PREFERRED EMBODIMENT

Figure 1:
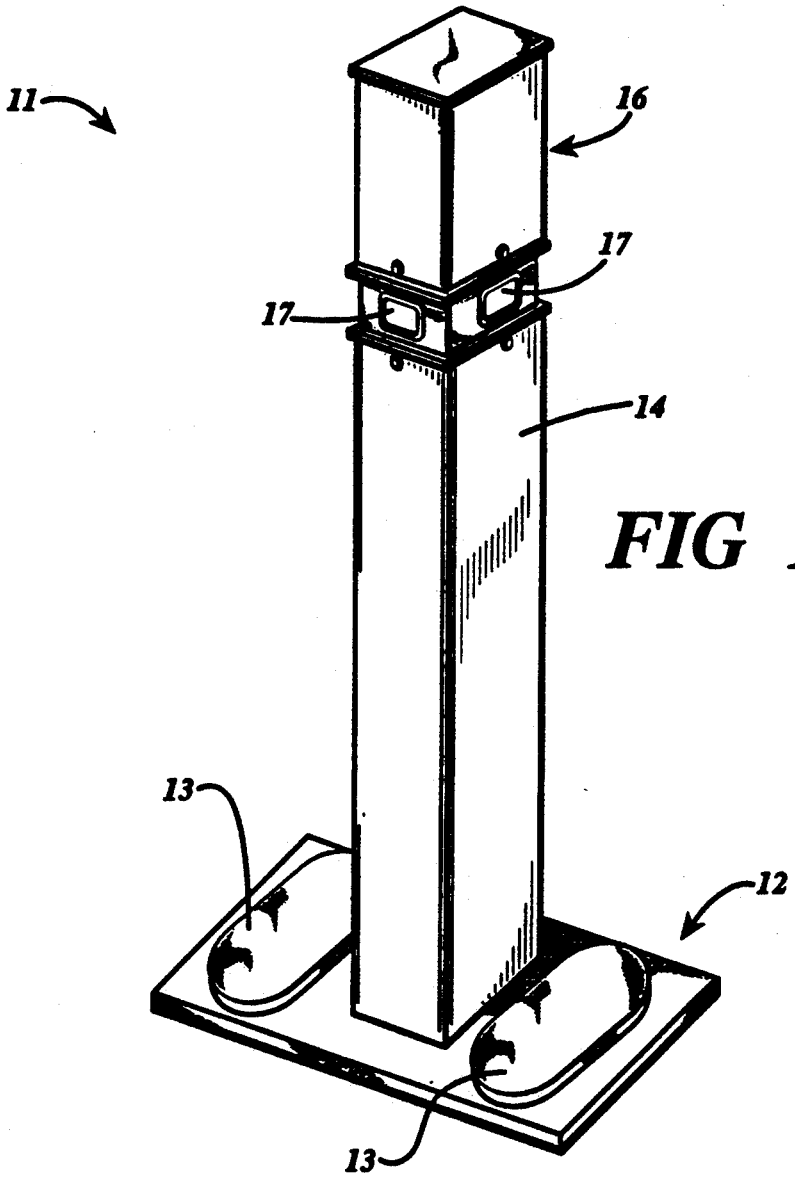
FIG. 1 is a perspective view illustrating the external appearance of an infrared sentry system that embodies principles of the present invention in a preferred form.

Referring now in more detail to the drawings, in which like numerals refer to like parts throughout the several views, FIG. 1 illustrates the external appearance of a housing that embodies principles of the invention in a preferred form. The housing 11 is seen to include a substantially rectangular base 12 that is preferably formed of a molded PVC or other sturdy plastic material. The base 12 is formed with a pair of spaced pods 13. The pods 13 are molded into the base 12 and are sized and shaped to receive and hold a corresponding pair of weights (not shown). The weights provide additional ballast for the base 12 so that it can support the housing 11 securely upon a floor or other surface.

A generally rectangular column 14 is secured to the base 12 between the spaced pods 13 and extends upwardly therefrom to an upper peripheral portion 16. The column 14 can be formed of extruded PVC or other suitable lightweight sturdy material and is sized to house within its interior the electronic components of the present invention.

Mounted at each face of the column 14 adjacent to the upper peripheral portion thereof is the lens portion 17 of a corresponding passive infrared (PIR) sensor. While only two lenses 17 are visible in the drawing of FIG. 1, it will be understood that the two sides of column 14 that are not visible are also provided with sensor lenses 17 as are the two visible faces. The lenses 17 can be chosen from any of a number of commercially available designs to provide a desired field of coverage for the infrared sensors mounted behind the lenses. It has been found that a lens that provides an approximately 90° field of view is preferred for the purposes of the present invention. In this way, the fields of view of adjacent sensors are substantially co-extensive such that the four sensors in combination provide a complete 360° field of coverage. Such a field of coverage is usually desirable, especially where the sentry of the present invention is centrally located in an area to be monitored.

Figure 2:
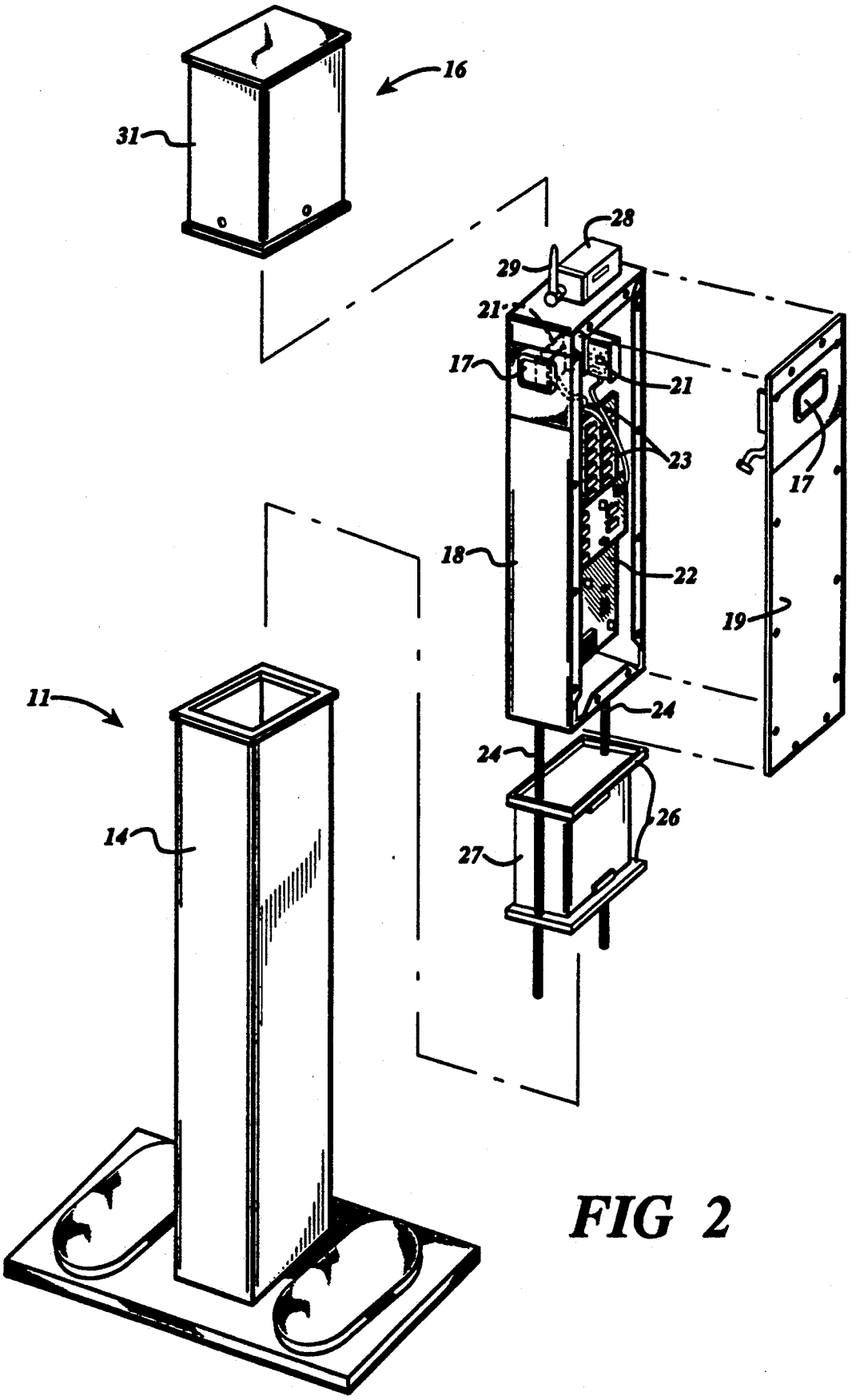
FIG. 2 is a perspective exploded view of the sentry of FIG. 1 showing the packaging and relative placement of its various internal components.

FIG. 2 is an exploded view of the apparatus of this invention showing a preferred method of mounting the electronic hardware of the invention within the column 14 of housing 11. More specifically, a metal chassis 18 is sized to contain the various electronic components of the invention and includes a cover 19 adapted to be secured with screws or the like to one side of the chassis as shown. PIR sensor boards 21 are mounted within the upper portion of the chassis 18. Each of the sensor boards 21 has its infrared detecting element positioned behind a corresponding one of the infrared lenses 17, which are secured to the outside of chassis 18 as shown. In this way, infrared energy within the field of coverage of each lens 17 is focused on two and collected by the infrared detector of a corresponding sensor board 21.

A microprocessor based controller board 22, which includes associated memory, control logic, and interface circuitry, is mounted within the lower portion of chassis 18. Each of the sensor boards 21 is coupled to the microprocessor board 22 via cables 23. In this way, a detection by one of the IR sensors of an intruder within its field of coverage is conveyed directly to the microprocessor board for processing as detailed below.

Suspended from the bottom of the chassis 18 on a pair of threaded rods 24 is a battery mounting bracket 26 for receiving and holding a rechargeable battery 27. The battery 27 provides power for operation of the electronic elements of the invention to provide a standalone system that can be moved conveniently to any area where monitoring is needed. The battery 27 is preferably of the sealed rechargeable variety and, in this regard, a battery sold under the tradename "Rocket" and marketed by the Global and Yuasa Battery Company Limited has been found highly satisfactory. Obviously, any of a number of suitable batteries might perform equally well.

A two-way radio transceiver 28 is secured to the outside of chassis 18 on the top thereof. The radio 28 is thus isolated by the metal of the chassis from the electronic components therein to provide for minimum interference between the radio and the internal electronics. The radio 28 is coupled to the microprocessor board 22 by a set of cables (not shown) through which the radios talk and listen circuitry can be selectively activated and through which voice messages can be relayed to the radio for transmission over the air. The radio's antenna 29 extends upwardly from the chassis 18 and is covered by and housed within the cap 31, which forms the upper peripheral portion of the column 14 and which is secured to the top of the chassis 18 by suitable means such as sheet metal screws.

With the just described configuration, the entire chassis and its electronics along with the battery and the two-way radio slip conveniently into the column 14 of the housing 11 and the cap 31 can be secured to the top of the chassis 18 to define the external appearance of the invention as depicted in FIG. 1.

Figure 3:
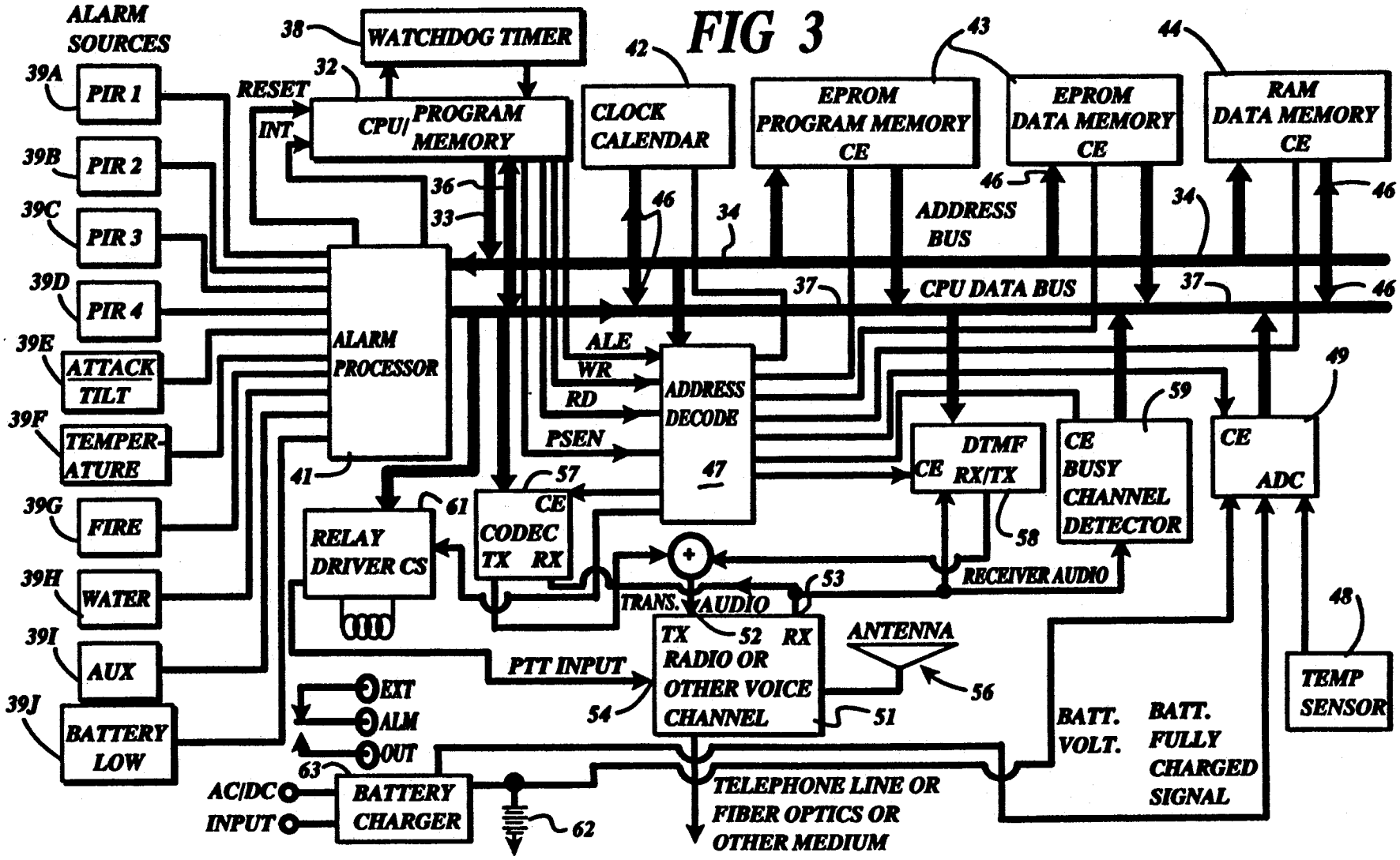
FIG. 3 is a hardware diagram illustrating preferred interconnections of internal electronic components of the system to perform the method of the invention.

FIG. 3 is a functional hardware schematic showing interconnections of the electronic components of this invention. The heart of the circuit is a central processing unit (CPU) 32. The CPU 32 functions as the brains of the system by receiving information from various peripherals such as passive infrared sensors, temperature sensors, fire sensors, and the like, processing the information, and controlling operation of the system according to pre-programmed instructions. While the CPU chip itself may be chosen from among any of a number of commercially available chips, it has been found that CPU Chip No. 80C51FA available from the Intel Corporation functions exceptionally well in the circuit of this invention.

The CPU 32 is coupled through an address port 33 to the address bus 34 of the circuit and through a data port 36 to the data bus of 37 of the circuit. As will be well understood by persons of ordinary skill in this art, various peripheral circuitry such as a power source, a crystal clock oscillator, and the like, are also coupled to the CPU for normal operation thereof. Such peripheral circuitry has been omitted from FIG. 3 for clarity of understanding.

A watchdog timer 38 is coupled to the CPU and functions to monitor the status of the CPU and its related hardware and to reset the CPU in the event of an abnormal condition of the hardware. The function of the watchdog timer 38, therefore, is to oversee the condition of the CPU and related chips and is a normal function of most CPU chips. In fact, in the Intel chip of the preferred embodiment, the watchdog timer is built into the CPU chip itself and functions transparently until an abnormal hardware or software condition occurs.

Also coupled to the CPU through the address and data busses of the circuit is a clock/calendar 42 that maintains the current date and time of day and that can make this information available to the CPU through the data bus 37 when desired. As will be detailed later, the date and time of day information is used by the CPU to implement a user input schedule for operation of the sensors and for various other functions that are performed on a periodic timed basis.

A set of erasable programmable read-only memory (EPROM) chips 43 are coupled to the CPU through its data and address busses. The memory provided by these EPROM chips is used to store invariant information and data such as the software program that controls the various functions of the system and the digitized preprogrammed set of words and commands that can be accessed and broadcast over the built in radio transmitter.

The system also includes random access memory (RAM) 44, which can be used to store changing or intermittent data during operation of the CPU and that also is used to store user input data such as custom digitized words or other commands input by the user of the system. As with the EPROM chips 43 and the clock/calendar 42, the RAM 44 is coupled to the CPU through the address and data busses of the circuit. As illustrated by the direction indicators 46, the data flow between the data bus and the ram can be in both directions such that information can be both written to and read from the ram during operation of the CPU. This is also true of the clock/calendar 42. The data and information stored in the EPROM chips, however, can only flow from the chips to the CPU and is not changeable by the CPU.

An address decoder chip 47 such as chip type 5C090 available from Intel, is coupled to the CPU, to the address bus, and to the various peripheral devices such as the EPROMs, the clock/calendar, the ram, and other chips. Upon receipt of a read or write instruction from the CPU, the address decoder determines from the address on the address bus which of the peripheral devices corresponds to the address and activates the corresponding device accordingly. The CPU might, for example, instruct the address decoder that it would like to retrieve the data stored in a particular address assigned to the ram chip 44. The address decoder would then read the prescribed address from the address bus, decode the address to determine that it indeed resided in the ram chip, and activate the ram chip to output the contents of the specified address onto the data bus, where it can be used by the CPU or by other peripheral devices coupled to the data bus.

An array of sensors 39A–39J are coupled to the system through an alarm processor 41. The alarm processor 41 preferably comprises a programmable logic device such as Intel Chip No. 5C090, programmed to que, prioritize, and present alarm status data to the central processor for analysis.

Sensors 39A–39D comprise the four passive infrared detectors that together comprise the primary alarm sources of the system. While numerous commercially available sensors including, but not limited to passive infrared, microwave, acoustic, and multi-technology sensors might be used satisfactorily in the system of this invention, it has been found that passive infrared sensors of the type available commercially from the Ademco Corporation perform exceptionally well. As previously discussed, each of the PIR sensors are positioned on a corresponding side of the column 14 of housing 11 just behind an infrared lens that focuses infrared energy onto the sensor. Upon detection of an intruder within the field of coverage of one of the sensors 39A–39D, the activated sensor conveys a signal to the alarm processor, which detects the signal and alerts the central processor accordingly by placing an appropriate message on the data bus.

As illustrated at 39C–39J, numerous other types of sensors might also be coupled to the system through the alarm processor. These may include an attack/tilt switch 39E, which might be a simple mercury switch, for detecting unauthorized movement of the sentry and reporting such to the central processor. Temperature, fire, and water sensors can also be coupled for detecting abnormally high temperatures, fire or smoke, or the rising of water above a predetermined level. An auxiliary input 39I can be provided for connecting door, window, or other alarm sources to the system through the alarm processor. Also, a battery low sensor 39J can be configured to detect when the battery voltage falls below a predetermined level and, in response, produce a signal that is interpreted and presented to the central processor by the alarm processor such that the system can respond to the low battery condition accordingly.

In addition to bi-state type sensors such as those illustrated at 39A–39J, analog type sensors such as temperature sensor 48, which produces an analog voltage proportional to the ambient temperature, can be coupled to the system through an analog-to-digital converter (ADC) 49. In this way, the central processor can retrieve the current temperature from the ADC for analysis and action, such as, for example, announcing the temperature at predetermined timed intervals.

A two-way radio transceiver 51, such as Model FTH2009 available from the Yaesu Corporation, is coupled to the central processor and can be activated thereby to transmit verbal commands appropriate to a given alarm or other condition. The transmitter 51 is preferably provided with an input 52 for receiving information to be transmitted, an output 53 through which signals received from an external transmitter are available, a "push to talk" input 54 that, upon receipt of an appropriate signal, places the radio transceiver 51 in the transmit mode, and an antenna 56 over which radio frequency signals are received and transmitted.

The input 52 and output 53 of the radio transceiver 51 are coupled to the central processor data bus through a coder/decoder (CODEC) chip, such as the commercially available Okie Chip No. MSM6388. The CODEC chip performs dual functions in the circuit illustrated in FIG. 3. In one mode, previously digitized voice commands can be retrieved from memory by the central processor and made available to the CODEC through the system data bus. The CODEC then converts the digitized voice commands back to their analog equivalents. These analog signals are then presented to the input 52 of the transmitter 51 for broadcast thereby.

In the second mode of operation of the CODEC, voice commands that are received by the transceiver 51 from a remote transmitter can be conveyed through the transceiver output 53 to the CODEC 57. The CODEC 57 can then convert the analog signals to their digitized equivalents and make these digitized equivalents available to the central processor through the data bus 37. The central processor can then store such commands for later retrieval and use. This function of the system is useful for receiving user input words or commands to supplement or enhance the list of commands prestored in the system EPROM 43.

The central processor 32 is also coupled to the input 52 and output 53 of the transceiver 51 through a Dual Tone Multi-Frequency (DTMF) Keypad encoder/decoder such as Chip Model No. MT8870BE available from the Mytel Corporation. The function of the DTMF 58 is similar to that of the CODEC 57 except that the DTMF encodes and decodes standard touch-tone keypad signals rather than verbal commands. In this way, digital information keyed into a remote radio transmitter and received by the transceiver 51 can be digitized and presented to the central processor through the data bus 37. Likewise, predetermined digitized keypad data can be converted by the DTMF to its analog tonal equivalent and transmitted over the transceiver 51 if desired. While DTMF type information is contemplated in the preferred embodiment, it will be understood that virtually any type of control signals, such as FSK signals, can be recorded and stored in EPROM or RAM for transmission by radio or other means. This capability is useful in the system for external programming of various functions of the system. For example, a security guard equipped with a two-way radio of the type having a digital keypad might transmit to the central processor a predetermined sequence of keyed characters representing a preprogrammed command. The central processor would then respond accordingly by, for example, announcing the time, temperature, or performing some other preselected function.

A busy channel detector 59 is coupled to the output 53 of transceiver 51 and can be activated to inform the central processor through the data bus as to whether the radio channel is busy, i.e. whether signals are being received from remote radio transmitter sources. This function is useful to ensure against inadvertent transmission while the channel is being used by others. In this regard, a relay or solid state driver 61 is coupled to the central processor and can be activated thereby to select the transmit mode of the transmitter 51 by an appropriate signal at the push to talk input 54.

A battery 62 provides power for operating the system of this invention and, when low, can be recharged by means of an internal or external battery charger 63. The battery and battery charger are coupled to the central processor through the ADC 49. In this way, the central processor can check the status of the battery and perform appropriate functions such as announcing its voltage, announcing that a charge is needed, shutting down the system to preserve the battery, or similar actions.

The CODEC 57, DTMF 58, busy channel detector 59, and relay driver 61 can be selected by the central processor through the address decoder. The selected device can then read information made available by the central processor on the data bus or can place information on the data bus for receipt by the central processor.

The system of the present invention as illustrated in FIG. 3 is preferably programmed to place itself in a standby or quiescent mode when there are no activated alarms or other signals to be processed. This is done to preserve battery power and to extend the life of the internal battery to its maximum possible extent. In the quiescent mode of the system, most of the electronic devices such as the CPU, the memory chips, the alarm processor, and the like, are placed in a standby mode in which they draw very little current. The system can then be "waked up" or activated upon the occurrence of anyone of a number of predetermined conditions such as the activation of a sensor, the detection of a low battery, or simply at predetermined time intervals for housekeeping purposes. The system is activated by means of either a reset or interrupt signal conveyed to the CPU.

FIGS. 4A–4E are functional flow diagrams illustrating the flow of a software program for controlling the system of this invention in a preferred way. It will be understood, however, that many and various schemes for programming the system may be employed with similar results. The flowcharts of FIGS. 4A–4E have been found to function efficiently and effectively for controlling the infrared sentry in a preferred user friendly way and are thus presented as illustrative examples.

In the preferred embodiment, the system can be "waked up" or activated upon the occurrence of five distinct conditions; namely, power on, power off, the activation of an alarm sensor, to perform housekeeping functions, or at predetermined time intervals to check the clock and implement a user input schedule for the IR sensors. The occurrence of any of these events resets the central processor and causes it to perform a number of functions depending upon the nature of the event.

Figure 4A:
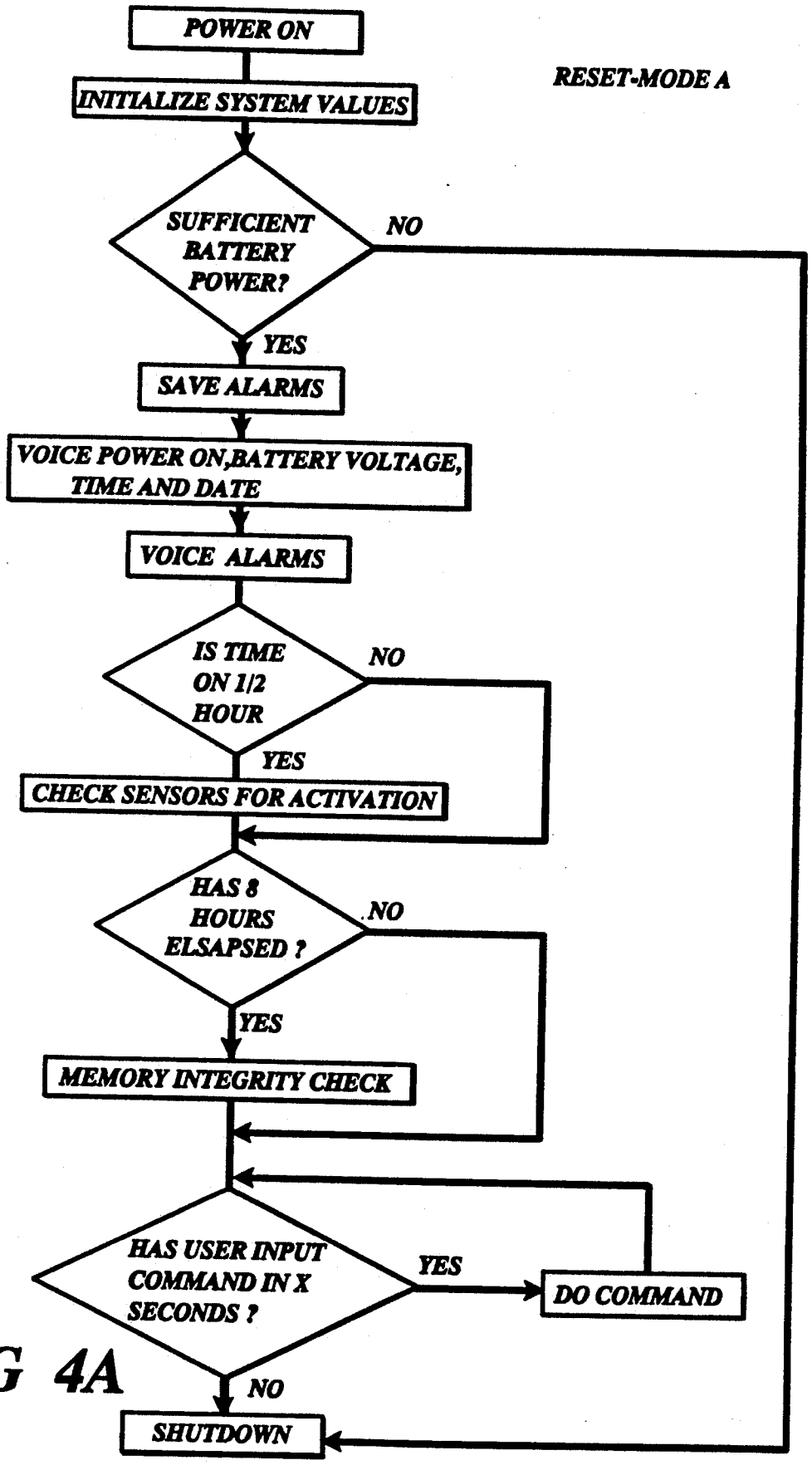
FIGS. 4A–4F are functional flow diagrams of a software package for controlling the microprocessor to perform the functions of the invention in a preferred way.

FIG. 4A illustrates the functions performed by the system when it is powered up or first turned on. First, various program parameters are initialized and a check is made to determine if the battery power is sufficient to operate the system. If the battery power is insufficient, the system is immediately shut down or placed in its standby mode. This prevents unnecessary power drain from a dangerously low battery and thus prevents damage to the battery.

If the battery power is sufficient, which is usually the case, the CPU is instructed to save the current status of all the alarms for future use. The central processor then reads the battery voltage, the temperature, the time, and the date, and selects from memory appropriate corresponding digitized voice commands. The central processor might, for example, select the following digitized words from the EPROM memory; "power", "on", "battery", "twelve", "volts", "temperature", "seventy", "five", "degrees", "seven", "thirty", "five", "pm", "June", "five". The push-to-talk input of the radio transmitter 51 is then activated and the selected sequence of words is conveyed to the audio input 52 of the transmitter through the CODEC 57. This sequence of words is then broadcast by the transceiver 51 to announce "power on, battery 12 volts, temperature 75, 7:35 pm, June 5". This transmission, of course, is received by all security guards in the vicinity that are equipped with a walkie-talkie style radio receiver such that the entire guard force is informed instantly that the infrared sentry has been turned on by someone.

Next, the previously saved status of the alarms is accessed and, if any of the alarms, such as one of the IR sensors, the fire sensor, the water sensor, or the like, have been activated, the central processor selects appropriate commands from its memory and voices the commands in a predetermined sequence to advise the guard force of the alarm. If, for example, Infrared Sensor No. 1 had been activated when the power was turned on, the system might voice the message "intruder Sensor 1". If no alarms have been activated, the system might simply voice the word "okay".

As mentioned earlier, a user of the present invention has the capability to input digital commands to the system through a two-way radio equipped with a keypad. A preferred method of allowing input of such commands is illustrated in FIG. 4F and will be discussed in detail herein below. One type of command that a user might wish to input could be a schedule for the four infrared sensors. A user might, for example, wish all four sensors to be on from 6:00 p.m. until 6:00 a.m. while only Sensor No. 4 should be on from 6:00 a.m. to 6:00 p.m. Such a schedule can be input to the system and stored in the random access memory by means of a digital keypad equipped two-way radio. Such commands are encoded and made available to the central processor through the DTMF Chip 58 as described above.

In FIG. 4A, after the status of the alarms has been broadcast, the system clock is checked to see if the current time falls on a half-hour. If so, the user input sensor schedule previously stored in ram is accessed and checked to see if any sensors are to be turned on or off at the present time. In the preferred embodiment, the user is only allowed to schedule the sensors upon half-hour intervals to save memory and battery power. Obviously, however, any desired scheduling increment could be provided by adding additional memory to the system.

In the preferred embodiment, the central processor is programmed to perform a memory integrity check every eight hours to detect any bad memory locations that might jeopardize operation of the system. After checking the schedule and setting the sensors accordingly, the system checks the clock to see if eight hours has elapsed since the last memory integrity check. If so, a new memory integrity check is performed as shown.

Finally, at the end of the memory integrity check, the user is provided with a predetermined time interval ("X" seconds) during which he can input digital commands to the system. Such a command might, for example, be a rescheduling of the sensors or an instruction to accept a user voice command transmitted over the user's two-way radio and store the verbal command for later access by the system. If the user initiates input of such a command within the "X" seconds provided, then the command is processed and another "X" seconds is provided for any additional commands. At the end of "X" seconds, the system is shut down or placed in its quiescent standby mode until the occurrence of another event causing reset and activation of the system. As an alternative, the system may be commanded to "surveillance" mode wherein the radio and CPU system remain "ON" listening for radio commands. This mode is useful where it may be desirable to adjust system settings frequently. This mode uses battery resources at a higher rate than normal.

Figure 4B:
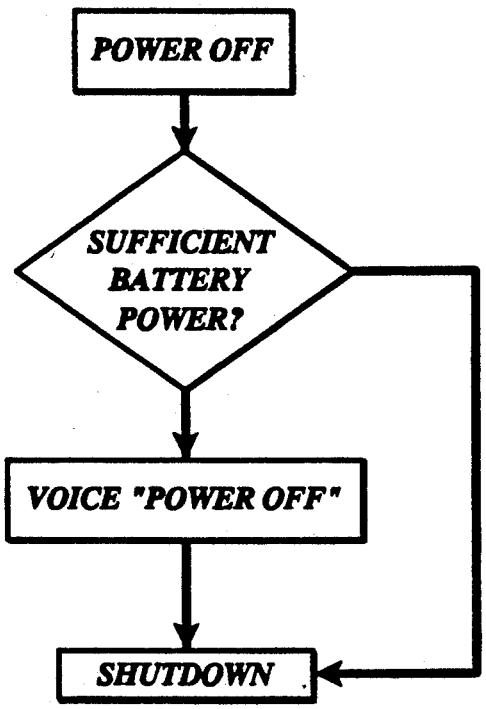

FIG. 4B illustrates the second of the five conditions that cause the system to be activated from its standby mode; namely, when the power is turned off by someone. Under this circumstance, the battery voltage is checked to assure that sufficient power is available. If it is, the system next selects the voice commands "power off" from the store of voice commands and broadcasts this message over the transceiver 51 prior to shutting the system down. In this way, all security guards in the vicinity are notified immediately that the sentry has been turned off. This assures that an intruder or other unauthorized individual cannot simply deactivate the sentry of this invention without the entire guard force being notified accordingly.

Figure 4C:
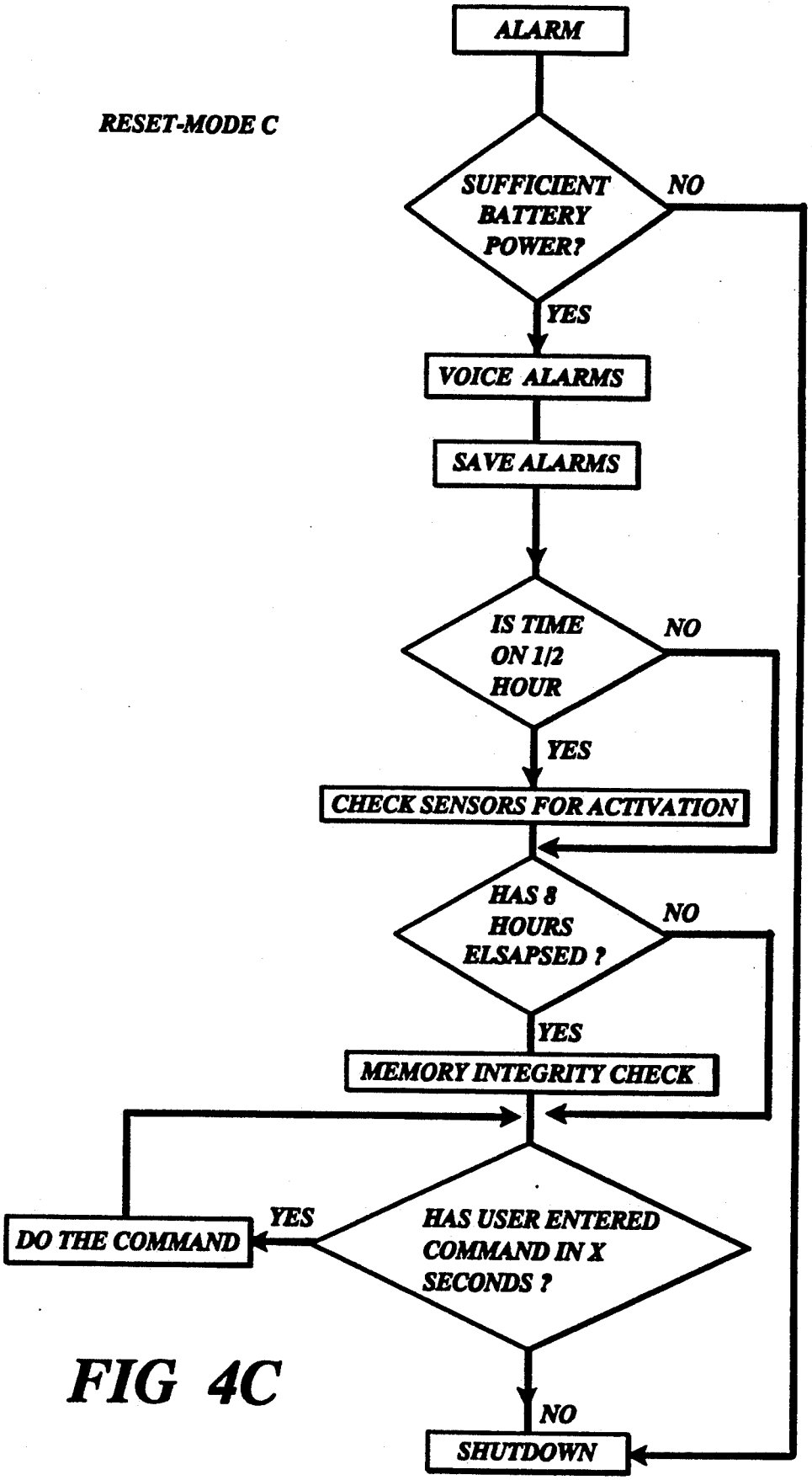

As illustrated in FIG. 4C, the third condition that can cause the system to be "waked up" from its standby mode is the activation of one of the sensors 39A–39J that are coupled to the central processor. Under these circumstances, the battery is first checked to ensure that there is sufficient power to operate the system. If so, an appropriate sequence of words corresponding to the particular activated sensor are selected from storage and broadcast in a predetermined sequence over the transceiver 51. For example, if an intruder was detected by Infrared Sensor No. 2, the system might broadcast the message "intruder Sensor 2". The security guard force members receiving this broadcast message can then investigate the report and take appropriate action.

Once the alarm message has been broadcast, the clock is checked to determine if the time is on a half-hour interval and, if so, and if the prestored schedule dictates, the sensors are turned on or off according to the schedule. Another check of the clock is then made to determine if eight hours has elapsed since the last memory integrity check and, if so, another memory integrity check is performed. Finally, the user, who is usually the sergeant or other guard in charge, is provided "X" seconds to enter commands into the system through his radio keypad. If a command is entered, then the command is executed, otherwise the system is shut down and placed in its standby power conserving mode until the occurrence of another event causing it to be "waked up".

Figure 4D:
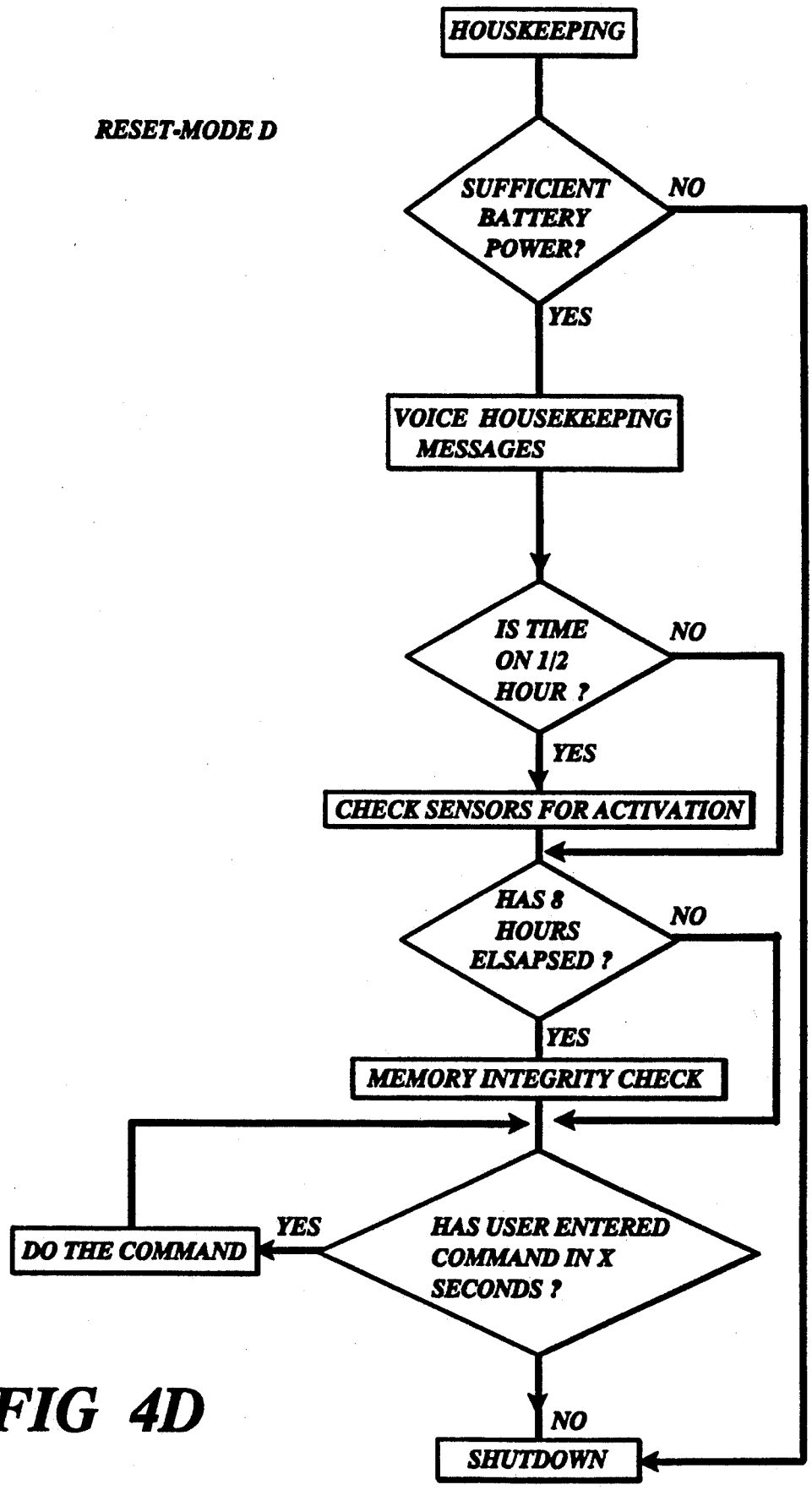

As illustrated in FIG. 4D, the fourth condition that might cause the system to be activated is internal housekeeping functions. Such functions might be performed periodically on a predetermined time basis. Alternatively, they might be user adjustable through a command entered during the "X" seconds just prior to system shut down. For example, the housekeeping function might be activated every thirty minutes to broadcast simple housekeeping messages to associated guards as a confidence measure to assure them that the system is up and running.

Upon activation for housekeeping purposes, the battery is first checked to ensure sufficient available power. Next, a predetermined series of housekeeping messages such as, for example, date, time, temperature, and the like are broadcast over the transceiver 51. Such a message, while conveying some useful information, acts primarily to reassure the guard force that the infrared sentry of this invention is operating normally. After announcing the housekeeping messages, the time is checked and, if it is a half-hour interval, and if the prestored schedule so dictates, the sensors are turned on or off according to the schedule.

Next, a memory integrity check is done if eight hours has elapsed since the last check and the system "listens" for "X" seconds to determine if a user keypad command is initiated. If so, the command is carried out and, if no further commands are started, the system is again shut down and placed in its standby mode.

Figure 4E:
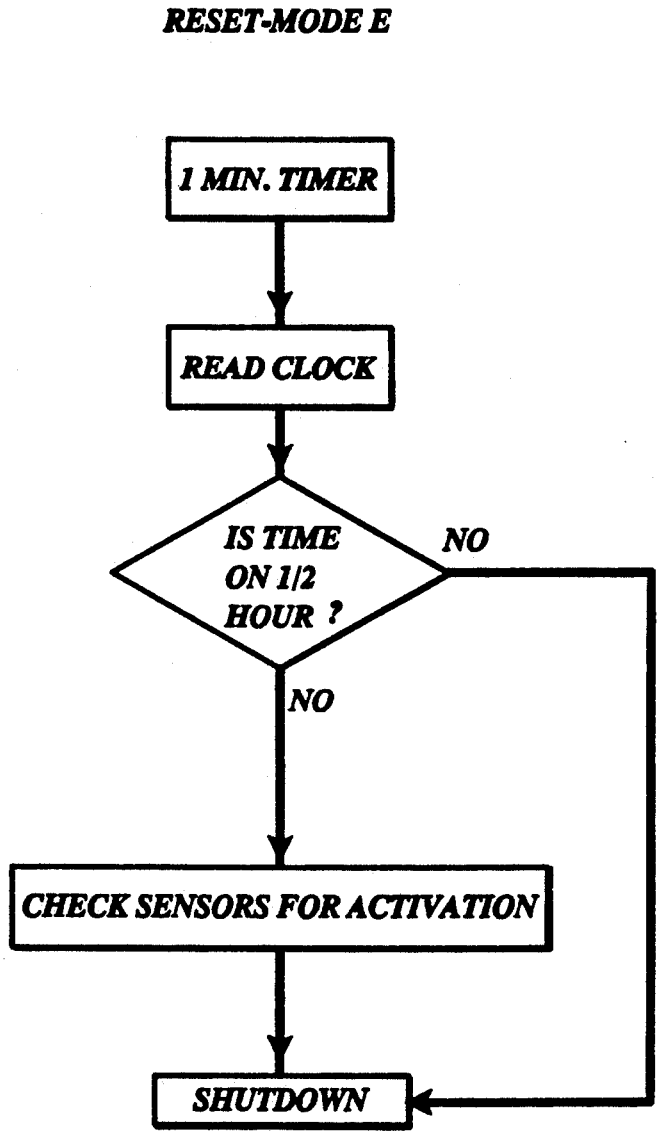
Figure 4F:
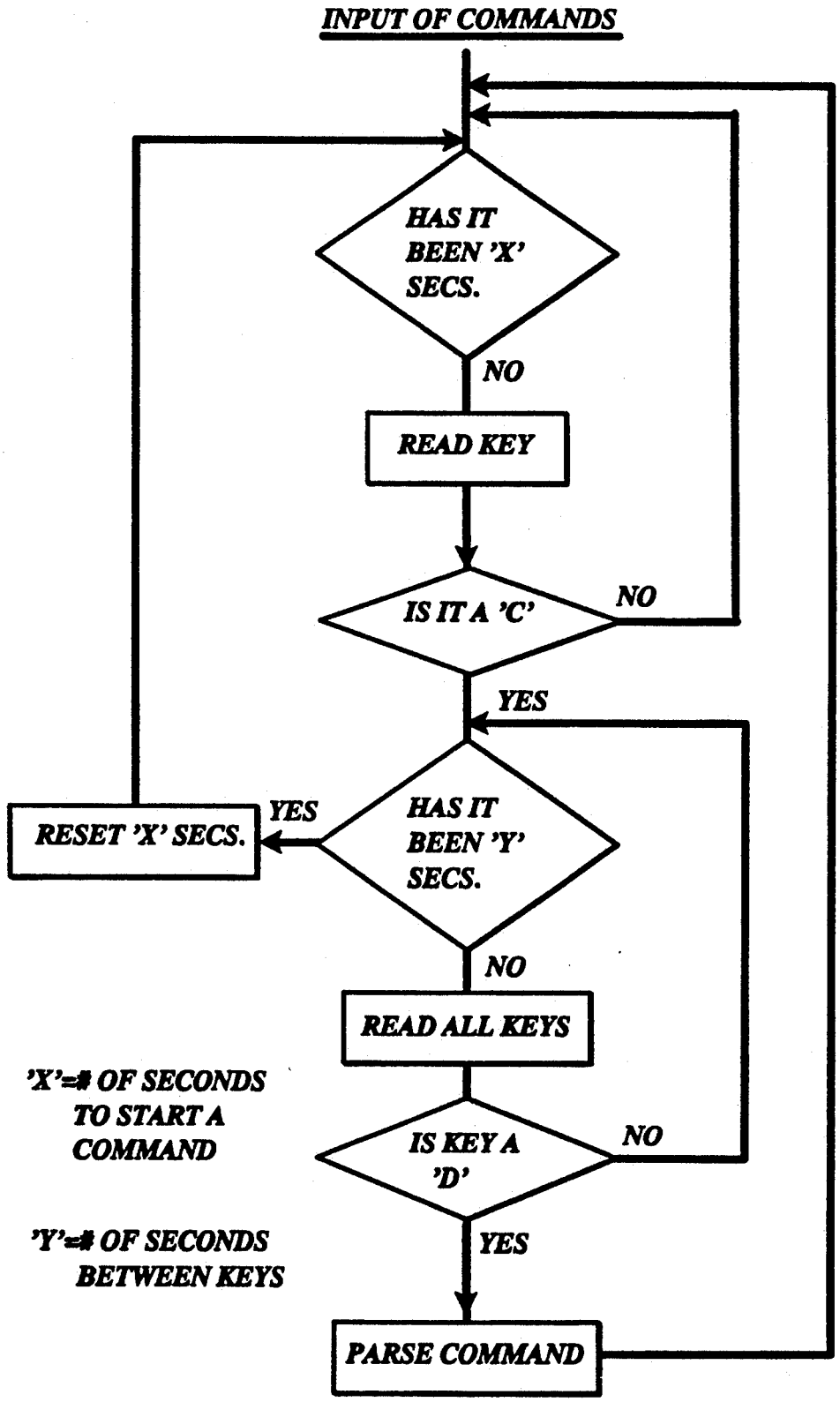

Finally, as illustrated in FIG. 4E, the central processor is activated briefly at one-minute intervals to check the clock and, if the time is on a half-hour interval, to turn the sensors on or off according to the prestored schedule. The system is then shut down into its power conserving mode.

FIG. 4E illustrates the sequence of events that occur if the user commences the input of a keypad command during the "X" seconds before system shut down. As previously mentioned, commands can be input by the user through a two-way radio equipped with a DTMF Keypad of the type commonly found on touch-tone telephones. In the preferred embodiment, a number of predetermined commands are stored in the system and, when activated through corresponding input from a remote keypad equipped transmitter, can instruct the system to perform a variety of tasks. For example, one command instructs the system to voice the time and date while another command instructs the system that the sequence of numbers to follow will correspond to a particular schedule for turning sensors on and off. A wide variety of such commands could obviously be implemented in the system.

In the preferred embodiment, the beginning of a user command is signaled by the input of a letter "c" from the remote transmitter keypad. The end of a command is designated with the letter "d" with the numbers and characters between the "c" and "d" corresponding to the particular command being transmitted. The command sequence "c 23 d", for example, might instruct the system to execute command number 23, which is preprogrammed and stored and which might transmit the current time and date.

Referring to FIG. 4F, if the user does initiate entry of a keypad command during the "X" seconds provided before shut down, the first key input is read to determine if it is a "c" indicating the commencement of a command. If the first input key is not a "c", then the system again begins to wait for "X" seconds for the entry of a valid command. If no command is entered in "X" seconds, then the system is shut down, i.e. placed in its standby mode.

If the first key of the command entered was a "c", indicating that the following sequence of characters will be a command, then the program accepts sequences of keypad entries, allowing "Y" seconds between each entry. Finally, when an entered key is a "d", indicating that the command is "done" or that this is the end of the command, the command string is passed to the central processor for evaluation and processing.

Obviously, since the various functions of the present system are implemented through software, a wide range of schemes can be employed easily to provide numerous capabilities. Following are some examples of software implemented functions that have been found to be desirable in the system of the present invention.

The passive infrared sensors of the preferred embodiment are provided by their manufacturer with adjustable sensitivities and thus adjustable ranges. The range of any one of the sensors can be adjusted by appropriate signals applied to the sensor board. In the preferred embodiment, the microprocessor controller is coupled to each sensor board and can apply appropriate signals thereto to adjust the gain or range of the sensor. Such an adjustment might be accomplished manually through a user command entered remotely via radio keypad. Alternately, such adjustments might be made periodically according to a prestored timing schedule. The controllable range of the sensors provides the capability to customize the field of coverage of the sentry to the size and shape of a particular area being monitored or to allow people in one region of a monitored area but to alarm if they enter other regions.

It has also been found desirable to provide for remote adjustment of the pre-stored sensor operation schedule of the system. Such adjustment is accomplished by appropriate commands entered through a remote radio keypad. This capability is important for changing a prestored schedule temporarily such that, for example, maintenance workers could enter the monitored area without being detected. If desired, the system operation can be switched from its scheduled mode to a manual mode wherein each of the sensors can be turned on or off and its sensitivity adjusted manually through appropriate remotely entered commands. Finally, it has also been found desirable to provide for preprogrammed holiday schedules. Such capability can be implemented through a table look-up process wherein if the current date is determined to be a particular holiday, the normal preprogrammed schedule for that day is overridden by a separate previously stored holiday schedule for that holiday.

As mentioned previously, the system is preferably provided through software with an automatic self test that is performed periodically. This test ensures the integrity of data contained in memory locations and of the internal condition of the central processor and its associated peripheral devices. Such a self test could be important in rare instances where stored data or information becomes corrupted, thereby degrading normal operation of the system. If such a condition is detected upon self test, an appropriate verbal command can be transmitted so that the system can be attended to appropriately. In addition, the preferred embodiment provides the user with the ability to adjust or change many of the system parameters remotely from his walkie-talkie radio. Adjustment can be provided for almost any internal operating parameter such as the number of seconds provided for entry of a command, system passwords, sensor schedules, and others. Such changes in parameters are received and stored in RAM memory and the system can be instructed to use the user input parameters instead of the system defaults. However, if upon self test the system detects a corruption or defect in this or any user input data in memory, the system automatically reverts back to the pre-stored defaults to avoid discontinuities or gaps in operation of the system.

The preferred embodiment is also provided with complete remote control of the various alarm messages. Such control includes the capability to playback previously broadcast messages, to record through a remote radio transmitter a voice message to override a system default message, or to specify any sequence of prestored words that should be broadcast in response to activation of any of the system sensors. All of these functions and more can be implemented remotely through commands entered into the keypad of a remote radio transmitter.

Finally, it has been found desirable to provide software assisted initial setting of the volume control on the internal radio transmitter of the system. Proper setting of the volume control is important to ensure clear transmission and reception of messages and commands. A preferred software implemented method of providing such assistance is for the central processor to "listen" or monitor the idle channel noise as the radio volume control is slowly adjusted by a user upon initial set-up of the system. The noise is compared continuously by the microprocessor to a precision voltage threshold and a periodic message is broadcast to the user indicating whether the monitored noise is below, above, or at the threshold. The threshold itself is chosen to correspond to the proper volume control setting for the radio transceiver. When such proper setting has been achieved, i.e. when the monitored noise is at the preselected threshold, the user is apprised accordingly via radio transmission and knows that the volume setting is optimum.

The system has been described herein in terms of a preferred embodiment. It will be obvious to those of ordinary skill in the art, however, that many variations might be made to the illustrated embodiment within the scope of the invention. For example, while the invention has been illustrated as broadcasting voiced commands over a two-way radio, it would be a simple matter to have the system dial a telephone number and broadcast the commands over telephone lines or other transmission means. The words "transmitter" and "transmission" as used herein should therefore be understood to refer to any means of transmitting verbal or coded messages to remote locations. In addition, a cellular telephone might be activated instead of the two-way radio of the preferred embodiment such that the system could make cellular phone calls and still be self-contained. Also, while the system has been illustrated as being self-contained in a single housing, it could obviously be supplied as a number of components for permanent installation. The central processor and associated electronics, for example, might be located in a housing hidden away in a ceiling or wall and having inputs for receiving signals from remote infrared and other sensors. Such a system might be useful for permanent installations in homes or offices. Finally, while the preferred embodiment communicates with the outside world via spoken messages, it will be clear that other types of coded messages or information could be substituted for the spoken messages of the preferred embodiment with similar results. These and numerous other additions, deletions, and modifications might well be made to the preferred embodiment without departing from the spirit and scope of the invention as set forth in the claims.

We claim:

1. An infrared electronic security sentry for monitoring a designated area, detecting the presence of unauthorized intruders within the monitored area, and alerting at least one individual upon detection of an intruder, said security sentry comprising:

a housing adapted to be positioned at a predetermined location within an area to be monitored;

at least one passive infrared sensor on said housing with said infrared sensor being positioned and oriented to detect the presence of an intruder within the monitored area and being adapted to produce a signal in response to such detection;

a radio transmitter in said housing for transmitting radio dispatched messages to be received at a remote location by a radio receiver;

storage means within said housing for storing a set of independently retrievable spoken words;

microprocessor means coupled to said sensor, said radio transmitter, and said storage means, said microprocessor means being programmed to detect a signal produced by said infrared sensor and upon said detection to retrieve from said storage means a corresponding subset of spoken words, arrange the words of the retrieved subset in a predetermined order to create a spoken message indicative of a sensed intrusion, activate said radio transmitter, and broadcast the spoken message formed by the arranged subset of spoken words over said radio transmitter;

a source of electrical power within said housing with said source being coupled to supply power for operation of said sentry; and a motion sensor within said housing for detecting movement of said sentry and producing a signal corresponding to such detection, said microprocessor means being coupled and programmed to receive signals from said motion sensor and upon receipt of such signals, to retrieve said storage means a corresponding subset of spoken words, arrange the retrieved subset of spoken words to form a message indicative of sentry movement, and broadcast the message thus formed over said radio transmitter, whereby remotely located security guards or others equipped with a radio receiver are informed verbally by the sentry of the detection of an unauthorized intruder within the monitored area.

2. A portable electronic security sentry comprising a housing, detector means on said housing for detecting the presence of an intruder in the vicinity of said sentry and producing an electronic signal in response to such detection, a transmitter in said housing for transmitting messages to be received at a remote location, electronic storage means in said housing with said storage means being adapted to store a set of digitized verbal commands, electronic control means within said housing with said control means being electronically coupled to said detector means, said transmitter, and said electronic storage means and being adapted to detect an electronic signal produced by said detector means and, in response, to retrieve a corresponding subset of digitized verbal commands from said storage means, activate said transmitter, and transmit the retrieved subset of digitized verbal commands in a predetermined sequence over said transmitter to indicate verbally that an intruder has been detected in the vicinity of said sentry, said detector means comprising at least one passive infrared sensor adapted to detect infrared energy emanating from an intruder in the vicinity of said sentry, said control means comprising an appropriately programmed microprocessor, and said sentry further comprising a motion detector for detecting movement of said housing and producing an electronic signal in response, said microprocessor being electronically coupled to said motion detector and being programmed to retrieve an appropriate subset of verbal commands, arrange them to form a message indicative of housing movement, and transmit the message thus formed over said transmitter, all upon production of a signal by said motion detector.

3. A security system comprising a plurality of detectors with each detector being adapted to sense a predetermined condition and produce a detection signal in response thereto, said system further comprising memory means for storing a plurality of discrete independently retrievable words, means responsive to a detection signal from one of said plurality of detectors for addressing said memory means and extracting therefrom an appropriate subset of words, arranging the retrieved subset in a sequence forming a message indicative of the condition sensed by said one of said plurality of detectors, means for transmitting the message thus formed to a remote location, and means for receiving auxiliary words from a remote location and means for storing the received auxiliary words in said storage means for retrieval and use along with previously stored words in formulating messages to be transmitted.

4. An infrared electronic security sentry for monitoring a designated area, detecting the presence of unauthorized intruders within the monitored area, and alerting at least one individual upon detection of an intruder, said security sentry comprising:

a housing adapted to be positioned at a predetermined location within an area to be monitored;

at least one passive infrared sensor on said housing with said infrared sensor being positioned and oriented to detect the presence of an intruder within the monitored area and being adapted to produce a signal in response to such detection;

a radio transmitter in said housing for transmitting radio dispatched messages to be received at a remote location by a radio receiver;

storage means within said housing for storing a set of independently retrievable spoken words;

microprocessor means coupled to said sensor, said radio transmitter, and said storage means, said microprocessor means being programmed to detect a signal produced by said infrared sensor and upon such detection to retrieve from said storage means a corresponding subset of spoken words, arrange the words of the retrieved subset in a predetermined order to create a spoken message indicative of a sensed intrusion, activate said radio transmitter, and broadcast the spoken message formed by the arranged subset of words over said radio transmitter;

a source of electrical power within said housing with said source being coupled to supply power for operation of said sensor;

a radio receiver in said housing for receiving coded command signals from a remote radio transmitter, said microprocessor means being coupled to said radio receiver and being programmed to read coded commands received thereby and perform predetermined tasks corresponding to such coded commands;

said microprocessor being programmed to receive spoken words from a remote radio transmitter and to add spoken words thus received to the set of independently retrievable spoken words stored in said storage means for subsequent retrieval and use along with previously stored spoken words in formulating messages to be broadcast over said radio transmitter.

5. A security sentry for monitoring a designated area, detecting the presence of unauthorized intruders within the monitored area, and broadcasting an alert message upon detection of an intruder, said security sentry comprising:

a housing adapted to be positioned at a predetermined location within the area to be monitored;

at least one intrusion sensor on said housing for detecting the presence of an intruder in the monitored area and producing a signal in response thereto;

at least one motion sensor in said housing for detecting unauthorized movement of said housing and producing a signal in response thereto;

at least one moisture sensor in said housing for detecting rise of water within the monitored area and producing a signal in response thereto;

clock means in said housing for maintaining the time of day and producing a signal indicative thereof;

a temperature sensor in said housing for detecting ambient temperature and producing a signal in response thereto;

storage means in said housing for storing a predetermined set of messages corresponding to the set of conditions sensible by said sensors and said clock means;

transmitter means in said housing for transmitting messages to a remote location;

control means in said housing with said control means being coupled to said sensors, to said clock means, to said transmitter means, and to said storage means and being adapted to detect signals produced by said sensors and said clock means, distinguish the signals from each other, retrieve from said storage means messages corresponding to detected signals, and transmit retrieved messages over said transmitter means; and a source of power within said housing with said source of power being coupled to supply power for operation of the elements of said security sentry.

6. In a security system of the type having sensors for detecting a predetermined condition, electronic storage means for storing a set of independently retrievable commands, transmitter means for transmitting messages to a remote location, and microprocessor means coupled to said sensors, said storage means, and said transmitter means with said microprocessor means being programmed to access said storage means upon detection by said sensors of the predetermined condition, retrieve from said storage means an appropriate subset of the independently retrievable commands, arrange the retrieved subset of commands in a pre-established sequence to create a message indicative of the detected condition, and activate said transmitter means to transmit the created message to a remote location, the improvement comprising receiver means coupled to said microprocessor means and being adapted to receiver supplemental commands from a remote location, said microprocessor means being further programmed to add supplemental commands received by said receiver means to the set of independently retrievable commands stored in said storage means so that the supplemental commands can be retrieved and used along with previously stored commands to create messages to be transmitted to a remote location through said transmitter means.

* * * * *